US007305731B2

(12) United States Patent
Graham

(10) Patent No.: US 7,305,731 B2
(45) Date of Patent: Dec. 11, 2007

(54) CARPET BRUSH FOR HAIR REMOVAL

(75) Inventor: Brandon Graham, Hudsonville, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 11/371,721

(22) Filed: Mar. 9, 2006

(65) Prior Publication Data

US 2006/0200926 A1 Sep. 14, 2006

Related U.S. Application Data

(60) Provisional application No. 60/659,786, filed on Mar. 9, 2005.

(51) Int. Cl.
*A46B 5/00* (2006.01)
*A46B 9/04* (2006.01)

(52) U.S. Cl. ..... 15/159.1; 15/160; 15/188; 15/207.2; 15/245; 15/245.1

(58) Field of Classification Search ..... None
See application file for complete search history.

(56) References Cited

U.S. PATENT DOCUMENTS 2,748,557 A * 6/1956 Eadie ..... 56/400.16
2,777,145 A * 1/1957 Krieger et al. ..... 15/186
3,633,237 A * 1/1972 Bagube ..... 15/188
3,838,474 A 10/1974 Erickson
3,999,244 A 12/1976 Brickley
4,107,808 A 8/1978 Schröder
4,244,168 A 1/1981 Howard
4,291,430 A 9/1981 Hightower
D270,971 S 10/1983 Stevens et al.
5,429,678 A * 7/1995 Fany ..... 134/6
D371,004 S 6/1996 Peischl et al.
D397,875 S 9/1998 Barrett
5,930,860 A * 8/1999 Shipp ..... 15/110
5,930,862 A 8/1999 Garrett
5,966,771 A * 10/1999 Stroud ..... 15/117
6,581,236 B2 * 6/2003 Jennings ..... 15/188
6,671,921 B1 1/2004 Hickman
2005/0055791 A1 * 3/2005 Lin ..... 15/228

FOREIGN PATENT DOCUMENTS

GB 2191392 A * 12/1987

* cited by examiner

*Primary Examiner*—David Redding
(74) *Attorney, Agent, or Firm*—McGarry Bair PC

(57) ABSTRACT

A fabric brush comprising a brush head having a top portion and a bottom portion. The bottom portion of the brush head has a plurality of projections extending downwardly therefrom. The plurality of projections comprise at least one row of aligned projections having a non-circular face extending opposite to the top portion of the brush head. The brush is disclosed for removing pet hairs from fabrics.

13 Claims, 2 Drawing Sheets

CARPET BRUSH FOR HAIR REMOVAL

CROSS-REFERENCE TO RELATED APPLICATION

This application claims priority to U.S. Provisional Patent Application No. 60/659,786 filed on Mar. 9, 2005 entitled CARPET BRUSH FOR HAIR REMOVAL.

FIELD OF THE INVENTION

This invention is drawn to a brush used to remove hair and other small debris from carpets, rugs, cloth furniture and other similar items.

BACKGROUND OF THE INVENTION

As most pet owners know, pet hair from shedding animals, such as dogs and cats, can easily get trapped in carpets, rugs, cloth furniture and other similar items. While a vacuum can suction up some of the hair, a good portion of the hair can become trapped within the fibers of the carpet, etc. such that a vacuum alone cannot suction up the hair. Vacuums also have similar problems suctioning up other small debris.

Heretofore, rug rakes, such as that disclosed in U.S. Pat. No. 5,930,862 to Garrett, have been used to rake carpets and rugs by pulling the rakes over the carpet to rake up the hair. Typically, these rug rakes include a plurality of bristles to rake the hair towards the user of the rake, wherein the user of the rake then has to pick up the hair. However, a more effective hair removal apparatus is desired.

SUMMARY OF THE PRESENT INVENTION

An aspect of the present invention is to provide a fabric brush comprising a brush head having a top portion and a bottom portion. The bottom portion of the brush head has a plurality of projections extending downwardly therefrom. The plurality of projections comprise at least one row of aligned projections having a non-circular face extending opposite to the top portion of the brush head.

Another aspect of the present invention is to provide a method of removing debris from fabric comprising providing a brush head having a top portion and a bottom portion, with the bottom portion of the brush head having a plurality of projections extending downwardly therefrom and the plurality of projections comprising at least one row of aligned projections having a non-circular face extending opposite to the top portion of the brush head. The method also includes pressing and rubbing the bottom portion of the brush head against carpet to bring the debris to a top surface of the fabric for easy removal.

These and other aspects, objects, and features of the present invention will be understood and appreciated by those skilled in the art upon studying the following specification, claims, and appended drawings.

BRIEF DESCRIPTION OF THE DRAWINGS

The following brief description of the figures, and the related figures themselves, exemplifies a particular preferred embodiment of the invention constituting the best mode presently contemplated. As will be understood, other embodiments of the invention, as well as changes and variations in the particular structure shown in these figures, are no doubt possible, and may very well suggest themselves to those skilled in the art after studying this disclosure and these figures.

DETAILED DESCRIPTION OF PREFERRED EMBODIMENT

Figure 1:
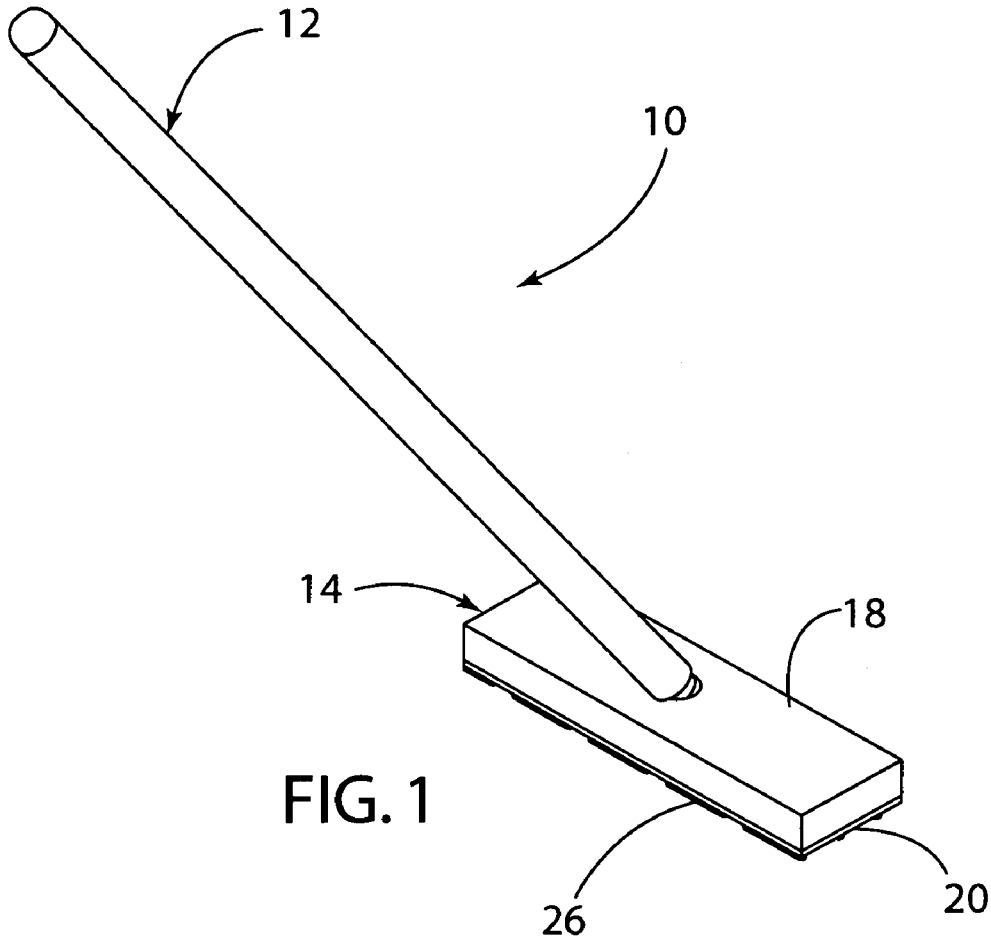
FIG. 1 is a perspective view of a carpet brush in accordance with the invention.
Figure 2:
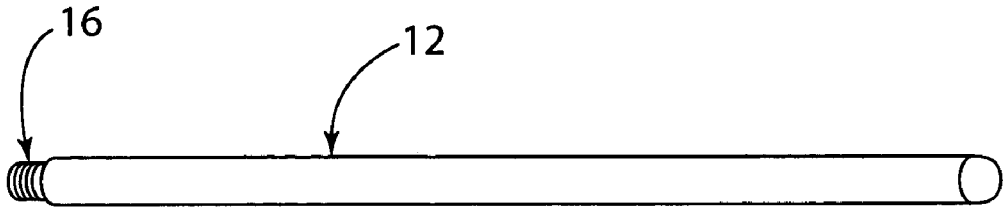
FIG. 2 is a perspective view of a handle of the carpet brush in accordance with the invention.
Figure 3:
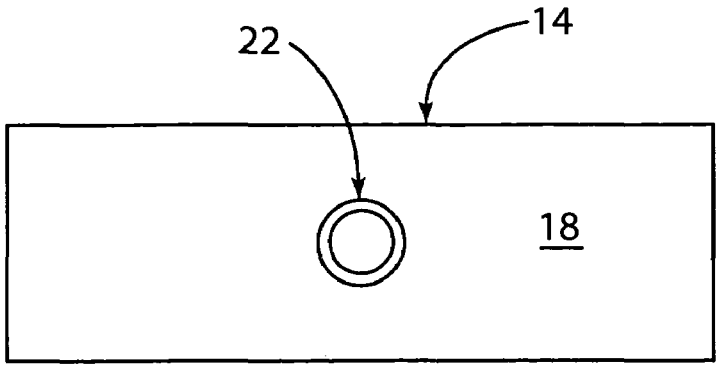
FIG. 3 is a top view of a brush head of the carpet brush in accordance with the present invention.
Figure 4:
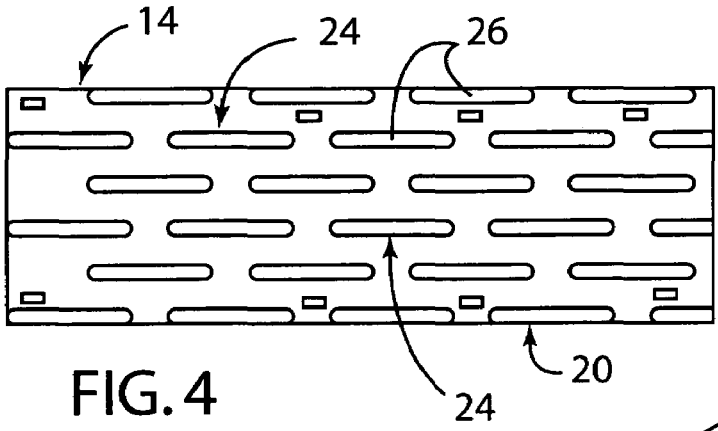
FIG. 4 is a bottom view of the brush head of the carpet brush in accordance with the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a carpet brush embodying the present invention. In the illustrated example, the carpet brush 10 includes a handle 12 and a brush head 14. During use, the carpet brush 10 is used by moving the brush head 14 over the carpet, rug, cloth furniture and other similar items having pet hair or other small debris therein to bring the pet hair or other small debris to the surface of the carpet, etc. to easily remove the hair or other small debris by hand or using a vacuum.

In the illustrated embodiment, the handle 12 is elongated such that a user of the carpet brush 10 can easily use the carpet brush 10 while standing. The illustrated handle 12 is circular and is approximately 4 feet long. However, it is contemplated that the handle 12 could be any length and have any cross-sectional shape. The handle 12 is preferably made of plastic, although it is contemplated that the handle 12 could be made of any material. Furthermore, it is contemplated that the handle 12 could be extendible. For example, the handle 12 could include a plurality of handle sections configured to be connected together to form a handle 12 of any desired length. Furthermore, the handle 12 could include a pair of telescoping tubes that can be rotated relative to each other as is well known to those skilled in the art to fix the handle 12 in a desired length or one of the tubes could have a plurality of openings configured to accept a spring loaded tab from the other of the tubes to fix the tubes in a desired extended position. In the illustrated embodiment, the handle 12 includes a threaded end 16 configured to be screwed into the brush head 14.

The illustrated brush head 14 is connected to the handle 12 and has a bottom configured to be brushed against the carpet, etc. to bring the hair and small debris to the surface of the carpet, etc. The brush head 14 includes a top portion 18 and a bottom portion 20. The top portion 18 of the brush head 14 includes an internal threaded opening 22 for accepting the threaded end 16 of the handle 12 therein for connecting the handle 12 to the brush head 14. However, it is contemplated that the handle 12 could be connected to the brush head 14 in any manner. For example, it is contemplated that the handle 12 and the top portion 18 of the brush head 14 could be molded as one integral piece. The top portion 18 of the brush head 14 is preferably made of plastic or wood and includes a rectangular shape, although it is contemplated that the top portion 18 of the brush head 14 could be made of any material and have any shape. The bottom portion 20 of the brush head 14 is connected to the top portion 18 and includes a plurality of projections 24.

In the illustrated example, the bottom portion 20 of the brush head 14 is connected to the top portion 18 of the brush head 14 and includes the plurality of projections 24 extending in a direction opposite the handle 12. The projections 24 are elongated and comprise a plurality of rows of ridges 26 having a non-circular face extending opposite to the top portion 18 of the brush head 14. Preferably, the face is oval. In the illustrated example, the ridges 26 in each row are aligned and are axially spaced from each other. Preferably, adjacent rows of ridges 26 are offset from each other, whereby the axial spaces between projections in one row are juxtaposed to projections in an adjacent row. Preferably, the projections 24 are elastomeric. In the illustrated example, the projections 24 are rubber. Furthermore, the projections 24 are relatively short and can extend from the bottom portion 20 of the brush head 14 is distance less than a largest dimension of the non-circular face of the ridges 26. In the illustrated embodiment, the entire bottom portion 20 of the brush head 14 is rubber and stapled to the top portion 18 of the brush head 14. However, it is contemplated that the bottom portion 20 of the brush head 14 could be connected to the top portion 18 of the brush head 14 in any manner. Furthermore, it is contemplated that the top portion 18 and the bottom portion 20 of the brush head 14 could be integral.

The illustrated carpet brush 10 is used by grasping the handle 12 and pressing the projections 24 of the brush head 14 against the carpet, etc. The handle 12 is then moved towards or away from the user of the carpet brush 10 while continuing to press the projections 24 against the carpet, etc. Preferably, the brush head 14 is moved in a direction perpendicular to the ridges 26. As the projections 24 are moved over the carpet, etc., the projections 24 will force the hair and/or other small debris towards the top of the carpet, etc. to thereby allow one to easily pick up or vacuum up the hair and/or other small debris. It is believed that at least one of the shape of the projections 24, the material of the projections 24 and/or the distance that the projections 24 extend from the rest of the bottom portion 20 of the brush head 14 help to make the carpet brush 10 very effective if forcing the hair and/or other small debris towards the top of the carpet, etc.

Figure 5:
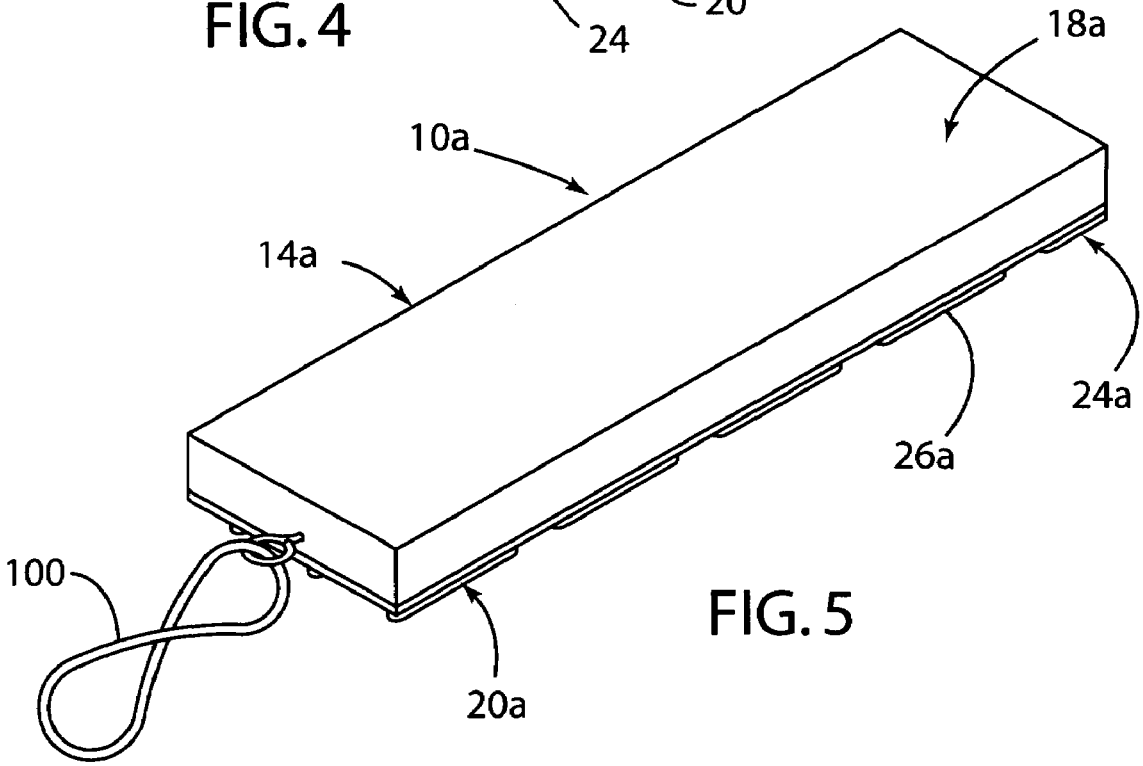
FIG. 5 is a perspective view of a brush head of a carpet brush in accordance with a second embodiment of the present invention.

The reference numeral 10*a* (FIG. 5) generally designates another embodiment of the present invention, having a second embodiment for the carpet brush. Since carpet brush 10*a* is similar to the previously described carpet brush 10, similar parts appearing in FIGS. 1-4 and FIG. 5, respectively, are represented by the same, corresponding reference number, except for the suffix "a" in the numerals of the latter. The carpet brush 10*a* is substantially identical to the first embodiment of the carpet brush 10, except that the second embodiment of the carpet brush 10*a* does not include a handle. Therefore, the carpet brush 10*a* includes a brush head 14*a* that has a bottom configured to be brushed against the carpet, etc. to bring the hair and small debris to the surface of the carpet, etc. The brush head 14*a* includes a top portion 18*a* and a bottom portion 20*a*. The top portion 18*a* of the brush head 14*a* is preferably made of plastic or wood and includes a rectangular shape, although it is contemplated that the top portion 18*a* of the brush head 14*a* could be made of any material and have any shape. The bottom portion 20*a* of the brush head 14*a* is connected to the top portion 18*a* and includes a plurality of projections 24*a*. The carpet brush 10*a* can also include a rope or other strap device 100 for easily holding and transporting the carpet brush 10*a*.

In the illustrated example, the bottom portion 20*a* of the brush head 14*a* is connected to the top portion 18*a* of the brush head 14*a* and includes the plurality of projections 24*a* extending in a direction opposite the handle 12*a*. The projections 24*a* comprise a plurality of rows of ridges 26*a*. In the illustrated example, the ridges 26*a* are aligned. Preferably, the projections 24*a* are elastomeric. In the illustrated example, the projections 24*a* are rubber. In the illustrated embodiment, the entire bottom portion 20*a* of the brush head 14*a* is rubber and stapled to the top portion 18*a* of the brush head 14*a*. However, it is contemplated that the bottom portion 20*a* of the brush head 14*a* could be connected to the top portion 18*a* of the brush head 14*a* in any manner. Furthermore, it is contemplated that the top portion 18*a* and the bottom portion 20*a* of the brush head 14*a* could be integral.

The illustrated carpet brush 10*a* is used by grasping the top portion 18*a* pressing the projections 24*a* of the brush head 14*a* against the carpet, etc. The top portion 18*a* is then moved towards or away from the user of the carpet brush 10*a* while continuing to press the projections 24*a* against the carpet, etc. As the projections 24*a* are moved over the carpet, etc., the projections 24*a* will force the hair and/or other small debris towards the top of the carpet, etc. to thereby allow one to easily pick up or vacuum up the hair and/or other small debris.

The foregoing detailed description is considered that of a preferred embodiment only, and the particular shape and nature of at least some of the components in this embodiment are at least partially based on manufacturing advantages and considerations as well as on those pertaining to assembly and operation. Modifications of this embodiment may well occur to those skilled in the art and to those who make or use the invention after learning the nature of this preferred embodiment, and the invention lends itself advantageously to such modification and alternative embodiments. For example, it is contemplated that the handle could comprise any element that would allow the user of the carpet brush to grasp the carpet brush. Therefore, it is to be understood that the embodiment shown in the drawings and described above is provided principally for illustrative purposes and should not be used to limit the scope of the invention. Furthermore, it is to be understood that such concepts are intended to be covered by the following claims unless these claims by their language expressly state otherwise.

I claim:

1. A method of removing pet hair from fabric comprising:

providing a brush head having:

a bottom portion comprising a plurality of rows of aligned projections with non-circular faces that are axially spaced from each other, wherein each of the elongated projections in one row is offset from projections in an adjacent row whereby the axial spaces between the projections in one row are juxtaposed to elongated projections in an adjacent row; and pressing and rubbing the bottom portion of the brush head against the fabric in a direction transverse to the rows of aligned projections to bring the pet hair to a top surface of the fabric for easy removal.

2. The method of removing pet hair from fabric of claim 1, wherein:

the projections are elastomeric.

3. The method of removing pet hair from fabric of claim 1, further including:

connecting a handle to the top portion of the brush head; wherein the handle extends from the brush head.

4. The method of removing pet hair from fabric of claim 3, wherein:

the handle comprises an extendible rod.

5. The method of removing pet hair from fabric of claim 1, wherein:

the bottom portion and the top portion of the brush head are not integral, but connected together.

6. The method of removing pet hair from fabric of claim 5, wherein:

the bottom portion of the brush head is elastomeric.

7. The method of removing pet hair from fabric of claim 6, further including:

stapling the bottom portion of the brush head to the top portion of the brush head.

8. The method of removing pet hair from fabric of claim 1, wherein:

pressing and rubbing comprises grasping the top portion of the brush head.

9. The method of removing pet hair from fabric of claim 1, wherein:

the faces are oval.

10. The method of removing pet hair from fabric of claim 1, further including:

removing the pet hair from the top surface of the fabric by hand.

11. The method of removing pet hair from fabric of claim 1, further including:

removing the pet hair from the top surface of the fabric using a vacuum cleaner.

12. The method of removing pet hair from fabrics of claim 1, wherein:

the rubbing of the bottom portion of the brush head against fabric comprises moving the brush head perpendicular to the plurality of rows.

13. The method of removing pet hair from fabric of claim 12, wherein:

the faces of the projections are substantially longer than they are wide.

* * * * *

UNITED STATES PATENT AND TRADEMARK OFFICE

CERTIFICATE OF CORRECTION

PATENT NO. : 7,305,731 B2
APPLICATION NO. : 11/371721
DATED : December 11, 2007
INVENTOR(S) : Brandon Graham It is certified that error appears in the above-identified patent and that said Letters Patent is hereby corrected as shown below:

Column 4, Claim 1, line 63, reads: "elongated projections in one row is offset from"

It should read: --projections in one row if offset from--

Column 4, Claim 1, line 66, reads: "taposed to elongated projections…"

It should read: --taposed to projections…--

Signed and Sealed this

Twentieth Day of May, 2008

JON W. DUDAS
*Director of the United States Patent and Trademark Office*